United States Patent [19]

Hollyday, Jr.

[11] 3,955,940

[45] May 11, 1976

[54] MIDDLE DISTILLATE PETROLEUM OILS CONTAINING COLD FLOW IMPROVING ADDITIVES

[75] Inventor: William C. Hollyday, Jr., Watchung, N.J.

[73] Assignee: Exxon Research and Engineering Company, Linden, N.J.

[22] Filed: Jan. 6, 1975

[21] Appl. No.: 538,931

[52] U.S. Cl. ..... 44/62; 44/70; 44/71; 44/72

[51] Int. Cl.[2] ..... C10L 1/22; C10L 1/14; C10L 1/18

[58] Field of Search ..... 44/62, 70, 71, 72

[56] References Cited

UNITED STATES PATENTS

| | | | |
|---|---|---|---|
| 3,443,917 | 5/1969 | Le Suer | 44/62 |
| 3,445,205 | 5/1969 | Patinkin et al. | 44/62 |
| 3,516,806 | 6/1970 | Malec | 44/72 |
| 3,635,685 | 1/1972 | Sonnenfeld | 44/62 |
| 3,640,691 | 2/1972 | Ilnyckyj et al. | 44/62 |
| 3,790,359 | 2/1974 | Feldman | 44/62 |

*Primary Examiner*—Floyd D. Higel
*Assistant Examiner*—Y. H. Smith
*Attorney, Agent, or Firm*—Roland A. Dexter; Frank T. Johmann

[57] ABSTRACT

Secondary amines having two straight chain aliphatic hydrocarbon groups of 8 to 30 carbon atoms each are wax crystal modifiers for middle distillate fuel oils and can be used in combination with polymeric pour point depressants and an amorphous petrolatum, to lower the pour point and/or improve cold flow properties of the oil.

16 Claims, No Drawings

MIDDLE DISTILLATE PETROLEUM OILS CONTAINING COLD FLOW IMPROVING ADDITIVES

BACKGROUND OF THE INVENTION

1. Field of the Invention

The invention relates to a combination of a secondary long chained aliphatic amine admixed with known wax crystal modifiers, usch as ethylene containing copolymers, for improving the cold flow properties of distillate fuel oil.

2. Description of the Prior Art

Various patents have taught the use of alkyl amines as additives for distillate fuel oils, primarily as anti-rust agents or to inhibit the formation of sediment or corrosion. Examples of such patents include U.S. Pat. No. 2,684,292 which teaches amine with at least 14 carbons as a sludge inhibitor in fuel oils containing cracked components; U.S. Pat. No. 2,672,408 which teaches amines as color stabilizers for distillate fuel oils; U.S. Pat. No. 2,456,569 wherein amines are used to stabilize diesel fuel against gum formation; U.S. Pat. No. 2,550,981 wherein amines are used to inhibit fogging of fuels in the presence of water and British Pat. No. 714,178 which teaches branched amines as color stabilizers in fuel oil.

Kerosene, which acts as a solvent for n-paraffin wax, had traditionally been a component of middle distillate fuel oils. Recently, with the increased demands for kerosene for use in jet fuels, the amount of kerosene used in middle distillate fuel oils has decreased. This, in turn, has frequently modifiers, the addition of wax crystal modifieres, e.g. pour point depressant additives, to the fuel oil to make up for the lack of kerosene. The more effective of these distillate oil pour depressants are copolymers of ethylene with various other monomers, e.g. copolymers of ethylene and vinyl esters of lower fatty acids such as vinyl acetate (U.S. Pat. No. 3,048,479); copolymers of ethylene and alkyl acrylate (Canadian Pat. No. 676,875); terpolymers of ethylene with vinyl esters and alkyl fumarates (U.S. Pat. Nos. 3,304,261 and 3,341,309); polymers of ethylene with other lower olefins, or homopolymers of ethylene (British Pat. Nos. 848,777 and 993,744); chlorinated polyethylene (Belgium Pat. No. 707,371 and U.S. Pat. No. 3,337,313); etc. However, in general, these ethylene backbone pour point depressants, while very effective in lowering the pour point of distillate oil, sometimes result in wax crystals having large particle sizes ranging from 1 millimeter up to an inch in their larger dimensions. These large particles tend to be filtered out by the screens and other filter equipment normally used in the fuel path of middle distillate fuel oil powered prime movers, e.g. diesel powered trucks, with a resulting plugging of these screens and filters even though the temperature of the oil is substantially above its pour point.

In my prior patent, U.S. Pat. No. 2,852,467, it was found that fatty acid salts of alkylene imine polymers were effective as pour point depressants in lubricating oil. Also, in U.S. Pat. No. 3,166,387, it was found that certain fatty acid salts of a secondary or tertiary monoamine having at least two $C_{10-22}$ alkyl groups, were effective as pour point depressants in distillate fuel oils. In my recently issued patent, U.S. Pat. No. 3,658,493, it was reported that certain fatty acid salts of a secondary or tertiary monoamine having at least two $C_{10-22}$ alkyl groups, were effective as pour point depressants in distillate fuel oils.

The low temperature flowability of a middle distillate fuel oil has been improved by the addition of a minor amount of an essentially saturated hydrocarbon fraction which is substantially free of normal paraffinic hydrocarbons and having number average molecular weight of from about 600 to about 3000 alone (U.S. Pat. No. 3,660,058) and in combination with: a copolymer of ethylene and an unsaturated ester (U.S. Pat. No. 3,790,359); a polymeric pour depressant of number average molecular weight within the range of about 800 and about 50,000 (U.S. Pat. No. 3,773,478); and either a polymer containing halogenated polymethylene segments or an N-aliphatic hydrocarbyl succinamic acid or derivative thereof (U.S. Pat. No. 3,846,093).

U.S. Pat. No. 3,419,395 teaches hydrogenated copolymers of butadiene and styrene as pour point depressants for distillate fuel oils.

It is also known to lower the pour point and improve the pumpability of distillate fuel oils by the addition of ethylene homopolymers and copolymers of ethylene with an olefinic monomer having from 3 to 6 carbon atoms (British Pat. No. 993,744) e.g. propylene (British Pat. No. 848,777).

SUMMARY OF THE INVENTION

The present invention utilizes as wax crystal modifiers, secondary amines of the general formula:

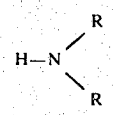

wherein each R is the same or different, saturated $C_8$ to $C_{30}$, preferably $C_{14}$ to $C_{24}$ alkyl group in combination with polymeric pour depressants and an amorphous petrolatum to improve the cold flow properties of middle distillate fuels.

Examples of such secondary monoamines include di-n-hexadecylamine; di-n-octadecylamine; n-hexadecyl-n-octadecylamine; di-n-dodecylamine; sec. hydrogenated cocoamine; arachidyl/behenyl amine; ditridecylamine; etc.

Amine mixtures may also be used and many amines derived from natural materials are mixtures. Thus, cocoamine derived from coconut oil is a mixture of primary amines with straight chain alkyl groups ranging from $C_8$ to $C_{18}$. Another preferred example is tallow amine, derived from hydrogenated tallow, which is a primary amine with a mixture of $C_{14}$ to $C_{18}$ straight chain alkyl groups. A particularly preferred amine because of its commercial availability is a secondary hydrogenated tallow amine having a mixture of $C_{16}$ and $C_{18}$ straight chain alkyl groups in a relative amount of about 10 to 45 wt. % of said $C_{16}$ groups and about 55 to 90 wt. % of $C_{18}$ groups. This amine can be readily prepared by reacting the fatty acid from tallow (beef) with ammonia, followed by hydrogenation. While the secondary dialkyl monoamines are very effective as wax crystal modifiers, other related amines were ineffective. For example, primary alkyl amines derived from the hydrogenated tallow acids was ineffective. Also an ammonium salt having the structure:

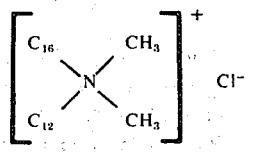

was tested and was ineffective in modifying the wax.

POUR POINT DEPRESSANTS

Known wax crystal modifiers that are useful in this invention are represented by pour point depressants, generally polymeric pour point depressants, which usually are polymers of ethylene, e.g. copolymer of ethylene and vinyl esters of lower fatty acids such as vinyl acetate (U.S. Pat. No. 3,048,479); copolymers of ethylene and alkyl acrylate (Canadian Pat. No. 676,875); terpolymers of ethylene with vinyl esters and alkyl fumarates (U.S. Pat. Nos. 3,304,261 and 3,341,309); polymers of ethylene with other lower olefins, or homopolymers of ethylene (British Pat. Nos. 848,777 and 993,744); and, chlorinated polyethylene (Belgium Pat. No. 707,371 and U.S. Pat. No. 3,337,313). Other classes of useful pour point depressants are: hydrogenated styrene-butadiene copolymers (U.S. Pat. No. 3,795,615); alkenyl succinamic acids (U.S. Pat. Nos. 3,444,082 and 3,544,467); etc.

The ethylene polymeric pour point depressants have a polymethylene backbone which is divided into segments by hydrocarbon or oxy-hydrocarbon side chains. Generally, this type will comprise about 3 to 40, preferably 4 to 20, molar proportions of ethylene per molar proportion of a second ethylenically unsaturated monomer, which latter monomer can be a single monomer or a mixture of such monomers in any proportion. These oil-soluble polymers will generally have a number average molecular weight in the range of about 1,000 to 50,000, preferably about 1,000 to about 5,000, as measured for example, by Vapor Pressure Osmometry, such as using a Mechrolab Vapor Pressure Osmometer Model 310A.

The unsaturated monomers, randomly copolymerizable with ethylene, include unsaturated mono- and diesters of the general formula:

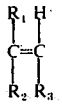

wherein $R_1$ is hydrogen or methyl; $R_2$ is a —$OOCR_4$ or —$COOR_4$ group wherein $R_4$ is hydrogen or a $C_1$ to $C_{16}$, preferably a $C_1$ to $C_8$ straight or branched chain alkyl group; and $R_3$ is hydrogen or —$COOR_4$. The monomer, when $R_1$ and $R_3$ are hydrogen and $R_2$ is —$OOCR_4$ includes vinyl alcohol esters of $C_2$ to $C_{17}$ monocarboxylic acids, preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$, such esters include methyl acrylate, isobutyl acrylate, methylmethacrylate, lauryl acrylate, palmityl alcohol ester of alpha-methyl-acrylic acid, $C_{13}$ oxo alcohol esters of methacylic acid, etc. Examples of monomers where $R_1$ is hydrogen and $R_2$ and $R_3$ are —$COOR_4$ groups, include mono- and diesters of unsaturated dicarboxylic acids such as: mono $C_{13}$ Oxo fumarate, di-$C_{13}$ Oxo fumarate, di-isopropyl maleate; di-lauryl fumarate; ethyl methyl fumarate; etc.

The aforementioned second monomers also include ketones containing a total of 4 to 24 carbons which can be represented by the general formula:

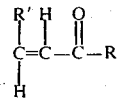

wherein R is a $C_1$ to $C_{16}$ hydrocarbon group such as aryl, alkaryl, cycloalkane, straight or branched chain alkyl group, etc. R′ is hydrogen or a $C_1$ to $C_5$ alkyl group. Preferably, R is a $C_1$ to $C_6$ alkyl group and R′ is hydrogen. Examples of such ketones include vinyl methyl ketone (i.e., R′ is hydrogen and R is methyl), vinyl isobutyl ketone, vinyl n-octyl ketone, etc.

Another class of monomers that can be copolymerized with ethylene include $C_3$ to $C_{16}$ alpha monoolefins, which can be either branched or unbranched such as propylene, isobutene, n-octene-1, isooctene-1, n-decene-1, dodecene-1, etc. Ethylene-higher olefin random copolymers useful as pour depressants and their preparation are described in U.S. Pat. No. 3,598,552.

Still other monomers include vinyl chloride, although essentially the same result can be obtained by chlorinating polyethylene. Or as previously mentioned, branched polyethylene can be used per se as the pour depressant.

These ethylene copolymer pour depressants are generally formed using a free radical promoter, or in some cases they can be formed by thermal polymerization, or they can be formed by Ziegler catalysts in the case of ethylene with other olefins. The polymers produced by free radical appear to be the more important and can be formed as follows; Solvent, and 0–50 wt. %, of the total amount of monomer other than ethylene, e.g. an ester monomer, used in the batch, are charged to a stainless steel pressure vessel which is equipped with a stirrer. The temperature of the pressure vessel is then brought to the desired reaction temperature and pressured to the desired pressure with ethylene. Then promoter, usually dissolved in solvent so that it can be pumped, and additional amounts of the second monomer, e.g. unsaturated ester, are added to the vessel continuously, or at least periodically, during the reaction time, which continuous addition gives a more homogeneous copolymer product as compared to adding all the unsaturated ester at the beginning of the reaciton. Also during this reaction time, as ethylene is consumed in the polymerization reaction, additional ethylene is supplied through a pressure controlling regulator so as to maintain the desired reaction pressure fairly constant at all times. Following the completion of the reaction, the liquid phase of the pressure vessel is distilled to remove the solvent and other volatile constituents of the reacted mixture, leaving the polymer as residue. Usually, to facilitate handling and later oil blending, the polymer is dissolved in a light mineral oil to form a concentrate usually containing 25 to 60 wt. % polymer.

Usually, based upon 100 parts by weight of copolymer to be produced, then about 50 to 1200, preferably 100 to 600, parts by weight of solvent, and about 5 to 20 parts by weight of promoter will be used.

The solvent can be any non-reactive organic solvent for furnishing a liquid phase reaction which will not poison the catalyst or otherwise interfere with the reaction, and preferably is a hydrocarbon solvent such as benzene, cyclohexane, and hexane.

In general, the promoter can be any of the conventional free radical promoters, such as peroxide or azo-type promoters, including the acyl peroxides of $C_2$ to $C_{18}$ branched or unbranched carboxylic acids, as well as other common promoters. Specific examples of such promoters, include dibenzoyl perioxide, ditertiary butyl peroxide, tertiary butyl hydroperoxide, diacetyl peroxide, diethyl peroxycarbonate, cumene hydroperoxide, alpha, alpha' azo-diisobutyronitrile, dilauroyl peroxide, etc.

The temperature used during the reaction will usually depend upon the choice of the free radical promoter and its rate of decomposition, and will usually range from 70° to 250°C. As a rule, lower temperatures, say 70° to 140°C., are preferred since these lower temperatures reduce the amount of ethylene side chain branching that occurs and generally improves the effectiveness of the polymer.

The reaction pressures employed will usually be in the range of 800 to 10,000 psig., for example 900 to 6,000 psig. This pressure can be attained by maintaining a fairly continuous and constant pressure on the reaction chamber through controlling the inlet feed of ethylene.

The time of reaction will depend upon, and is interrelated to, the temperature of the reaction, the choice of promoter, and the pressure employed. In general, however, ½ to 10, usually 1 to 5, hours will complete the reaction.

Specific examples of the preparation of these polymers are given in various patents, e.g. U.S. Pat. Nos. 3,048,479; 3,093,623; 3,126,364; etc.

Another wax crystal modifier that can be used to advantage with the secondary amines are succinamic acid materials. A description of these materials is given in U.S. Pat. Nos. 3,444,082 and 3,544,467.

The alkenyl succinamic acids preferably (n-aliphatic hydrocarbyl) succinamic acids will, for the most part, have the following formula:

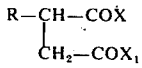

wherein R is a straight chain aliphatic hydrocarbon group having from 0 to 1 sites of olefinic unsaturation (alkyl or alkenyl) attached at a secondary carbon atom to the succinyl group and is of at least 14 carbon atoms, generally in the range of 15 to 40 carbon atoms and more usually in the range of 15 to 30 carbon atoms. One of X and $X^1$ is hydroxyl and the other is:

$-NYY^1$ wherein N has its normal meaning of nitrogen and Y and $Y^1$ are aliphatic hydrocarbyl groups of from 14 to 40 carbon atoms, more usually of from 15 to 30 carbon atoms, having a total of from about 30 to 52 carbon atoms, more usually of from 32 to 48 carbon atoms, and, preferably, of from 32 to 40 carbon atoms.

Y and $Y^1$ can be aliphatically saturated or aliphatically unsaturated, generally free of acetylenic unsaturation (alkyl or alkenyl). There may be from 1 to 2 sites of olefinic unsaturation. Y and $Y^1$ may be the same or different and may be straight chain or branched chain, preferably straight chain. The branches will normally be not greater than 1 carbon atom, i.e., methyl. The position of attachement to nitrogen may be at a terminal or internal carbon atom.

As is evidenced from the above formula, it is not important which position the alkyl or alkenyl group has in relation to the carboxamide or carboxyl group. Because of the bulky nature of the amine, the usual method of preparation through the succinic anhydride will provide the alkenyl group $\beta$ to the carboxamide as the major product. To the extent that there is the more easily accessible derivative, this derivative is preferred. However, as far as operability is concerned, either isomer or a mixture of the two isomers may be used.

Individual compounds or mixtures of compounds may be used. Mixtures of different C- and/or N-substituents, both as a homologs and isomers, will frequently be employed when the individual precursors to the succinamic acid product are not readily available.

Illustrative succinamic acids include N,N-dihexadecyl hexadecylsuccinamic acid, N-hexadecyl, N-octadecyl octadecylsuccinamic acid, N-N-dihexadecenyl $C_{15-20}$-alkenylsuccinamic acid, N-hexadecenyl N-eicosenyl octadecylsuccinamic acid, N,N-diotadecenyl $C_{16-18}$-alkenylsuccinamic acid, etc.

As indicated previously, the succinamic acid may be used as its amine salt, preferably as a mixture of acid and amine salt.

The amine salt of acid or mixtures thereof can be represented by the following formula:

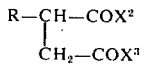

wherein R is as previously defined, one of the $X^2$ and $X^3$ is $-NYY^1$ wherein Y and $Y^1$ have been previously defined. The other of $X^2$ and $X^3$ is of the formula:

$-OH(NYY^2Y^3)_n$ wherein $Y^2$ and $Y^3$ may be hydrogen, aliphatic hydrocarbon of from 1 to 30 carbon atoms or oxaliphatic hydrocarbon (there being 1 ethereal oxygen atom present in the radical bonded to nitrogen at least $\beta$ to the nitrogen atom) of from 3 to 30 carbon atoms. $Y^2$ and $Y^3$ may be taken together to form a heterocyclic ring of from 5 to 7 members having nitrogen and oxygen as the only heteromembers, $n$ varies from 0 to 1, preferably from 0.1 to 0.9. That is, from 10 to 90 mole percent of the succinamic acid present is in the form of its salt.

The aliphatic hydrocarbon groups are preferably saturated and if unsaturated usually have no more than 2 sites of ethylenic unsaturation. The total number of carbon atoms for $HNY^2Y^3$ will be from 0 to 60, usually 1 to 40.

The groups indiciated for Y and $Y^1$ may also be used for $Y^2$ and $Y^3$. However, as already indicated, primary amines may be used as well as secondary amines to form the salt. Usually, where an amine other than the one used to prepare the succinamic acid is used to form the salt, as will be explained subsequently, there will be a mixture of salts; both the added amine and the secondary amine employed to prepare the succinamic acid will be involved in salt formation.

Illustrative amines which may be used to form salts are di-sec-butyl amine, heptyl amine, dodecyl amine, octadecyl amine, tert-butyl amine, morpholine, diethyl amine, methoxybutylamine, methoxyhexylamine, etc.

The alkenyl succinamic acids of this invention are readily prepared by reacting an alkyl or alkenyl succinic anhydride with the desired secondary amine at a temperature in the range of about 150° to 250°F. in approximately equimolar amounts, either neat or in the presence of an inert solvent. The time for the reaction is generally in the range of 15 minutes to 1 hour. This reaction is well known in the art and does not require extensive discussion here.

The alkyl or alkenyl succinic anhydride which is used may be individual compounds or mixtures of compounds. That is, various alkyl or alkenyl groups of differing number of carbon atoms or different positions of attachment to the succinic anhydride group may be used. Alternatively, a single isomer may be used. Since mixtures are generally more readily available, to that degree they are preferred. Frequently, mixtures will be used of aliphatic hydrocarbyl substituted succinic anhydrides wherein no single homolog is present in amount greater than 25 mole percent, each homolog being present in at least 5 mole percent.

Various secondary amines may be used, both those having the same aliphatic hydrocarbon groups and those having different aliphatic hydrocarbon groups. Either alkyl or alkenyl substituents may be present on the nitrogen, each having at least 14 carbon atoms. The range of difference between the two aliphatic hydrocarbon groups bonded at the nitrogen is not critical, but will generally be fewer than 8 carbon atoms, more usually fewer than 6 carbon atoms. For most part, the aliphatic hydrocarbon groups will be straight chain, i.e., normal, with the amino nitrogen bonded either to internal or terminal carbon atoms.

It is found that when using approximately a 1:1 mole ratio of amine to succinic anhydride, depending on the reaction conditions, a significant amount of amine may be unreacted and remain to form the salt of the succinamic acid which is formed. In some instances, as much as 30 percent of the amine may remain unreacted, forming a significant amount of salt. Thus, the salt will frequently be from 10 to 30 mole percent of the total succinamic acid present.

Also, in situations where significant amounts of water are present during the course of the reaction, the water may react with a succinic anhydride to form succinic acid. If the temperature is not high enough to regenerate the succinic anhydride, the succinic acid will probably remain unreacted or form the amine salt with available unreacted amine. Therefor, the mixtures of amic acid salts may be conventiently prepared merely by using a 1:1 mole of amine to succinic anhydride, and not attempting to drive the reaction to completion, or up to a mole excess of amine.

The amine salts are readily prepared by adding the amine to the succinamic acid, conveniently as prepared, or in an inert solvent. Mild heating may faciliate the reaction.

A still further wax crystal modifier that usefully cooperates with the secondary amines of the invention as coadditives for improvement of cold flow properties of distillate fuel oils are the hydrogenated styrene-butadiene rubbers as disclosed in U.S. Pat. No. 3,646,142. The styrene-butadiene copolymer is hydrogenated under typical conditions such as in the presence of nickel-alkylaluminum catlayst and cyclohexane solvent, with a hydrogen pressure for example of 200 pounds per square inch. Hydrogenation is controlled by infrared absorbance of the product to reduce the olefinic unsaturation without reducing the aromatic content of the polymer. An optimum degree of hydrogenation is necessary for maximum pour depression as described in this patent.

Chlorinated hydrocarbon polymers are known to be useful as pour point depressants for distillate fuels. For the purposes of this invention the polymers are either polyethylene or copolymers of ethylene and a monoolefinic hydrocarbon having from 3–6 carbon atoms, said copolymers being at least 50 mole percent ethylene which polymers have a chlorine content of from about 4 to about 35 percent by weight. The chlorine containing polymer has an average number molecular weight ($\overline{M}n$) ranging from about 1,000 to about 20,000 (measured by vapor pressure osmometry). Typical of a highly useful chlorinated polymer is polyethylene having a branch index of not more than about 5 and a ($\overline{M}n$) of about about 1500–2500 prior to chlorination and a chlorine content of 10–30% after chlorination. Branch index is the number of non-terminal methyl groups per 100 carbon atoms of polymer.

Chlorinated hydrocarbon polymers are conventionally produced polymers and copolymers of ethylene of the suitable molecular weight range, e.g. catalytically produced by means of peroxides and thereafter chlorinated with chlorine as by bubbling chlorine through the molten polymer at between 65°C. and 200°C. or through the polymer suspended in an inert solvent as carbon tetrachloride at a temperature of at least 25°C.

AMORPHOUS PETROLATUM

The amorphous petrolatum used to advantage in combination with the secondary amines and pour point depressants according to this invention is defined as an essentially saturated hydrocarbon fraction which is substantially free of normal paraffin hydrocarbons, i.e. containing no more than about 5 wt. %, and preferably no more than about 1 wt. %, of normal paraffin hydrocarbons. These waxes can be added to the fuel oil in a concentration of about 0.001 to about 0.2 wt. %. While not known with certainty, it is believed that the active flow improvers in these waxes are the isoparaffins and the cycloparaffins.

The aforesaid amorphous wax fractions are obtained by dewaxing a deasphalted residual petroleum fraction which fraction will have viscosities of at least 125 SUS at 99°C., e.g. bright stocks. Dewaxing is done by conventional methods such as by propane dewaxing or ketone dewaxing.

In some instances, the waxes obtained by this procedure will be naturally low in normal paraffin hydrocarbons and can be used in the present invention without further treatment. For example, by deasphalting a residual oil from certain Texas coastal crudes and then dewaxing the residual fraction, an amorphous-microcrystalline wax can be obtained which has only a trace of normal paraffins, about 5% of isoparaffins, about 73% of cycloparaffins and about 22% of aromatic hydrocarbons. In other instances, it is necessary to treat the wax fraction in some manner to reduce its content of normal paraffins. Thus, for example, a microcrystalline wax fraction may consist predominantly of two components, viz. a normal paraffin wax and an isoparaffin wax. Separation of these two materials can be achieved by a solvent treatment. Thus the wax can be dissolved in heptane at its boiling point and then when the solution is cooled to room temperature the normal paraffins will be predominantly precipitated and the resultant supernatant solution will give a mixture containing some normal paraffins but predominating in isoparaffins. Removal of normal paraffins from a microcrystalline wax or amorphous wax can also be effected by complexing with urea. A mixture of n-paraffinic and amorphous waxes in a volatile solvent is treated with urea. The n-paraffinic wax associates with the urea to form a solid. This solid is separated by filtration or centrifugation from the amorphous wax which remains in solution, and which can be recovered upon evaporating the solvent.

The amorphous or microcrystalline waxes that are used in this invention will have melting points within the range of about 25°C. to 60C., and number average molecular weights within the range of about 600 to 2000 e.g. 600 to 1100.

The most common petroleum middle distillate fuels are kerosene, diesel fuels, jet fuels and heating oils. Since jet fuels are normally refined to very low pour points there will be generally no need to apply the present invention to such fuels. The low temperature flow problem may arise occasionally with kerosene but it is most usually encountered with diesel fuels and with Number 2 heating oils. The specifications for a representative kerosene include a 10% ASTM distillation point of about 200° to 220°C., a 90% distillation point of about 260°C., and a final boiling point of about 275° to 290°C. A representative Number 2 heating oil specification calls for a 10% distillation point no higher than about 225°C., a 50% point no higher than about 270°C., and a 90% point of at least 280°C. and no higher than about 335°C. to 345°C., although some specifications set the 90% point as high as 355°C. Heating oils are preferably made of a blend of virgin distillate, e.g. gas oil, naphtha, etc., and cracked distillates, e.g. catalytic cycle stock.

As discussed, the ethylene backbone pour point depressants, while very effective in lowering the pour point of distillate oil, sometimes result in wax crystals having large particle sizes ranging from 1 millimeter up to an inch in their larger dimensions. These large particles tend to be filtered out by the screens and other filter equipment normally used on delivery trucks and fuel oil storage systems, with a resulting plugging of these screens and filters even though the temperature of the oil is substantially above its pour point. The present invention is based on the discovery that the secondary amines of the invention supplement the pour point dispersant by keeping the particle size of the crystals which are usually sufficiently small to pass through the screens and filter equipment so as not to cause plugging, and at the same time do not unduly interfere with the action of the pour point depressant in preventing the oil from freezing.

The additives of the invention are particularly useful in diesel fuels in view of the current tendency and desire to increase the cloud point of diesel fuels by raising the maximum distillation point. One advantage of increasing the diesel fuel cloud point is that the fuel contains a larger amount of hydrocarbons of higher molecular weight which in turn increases the BTU value of the fuel and gives operating economies during the operation of diesel engines, for example, diesel trucks. Diesel fuels conventionally have pour points on the order of −28°C. However, by increasing the cloud point to increase the BTU value of the fuel, the diesel fuels will then have pour points on the order of −15° or −13°C. This higher pour point in turn brings about the requirement for reduction of pour point which can be accomplished by the addition of wax crystal modifying additives of the invention. In the normal operation of diesel trucks, the diesel engine is provided with a fine mesh screen, usually about 60 mesh, as a filter ahead of the engine. However, in cold weather with diesel fuels having pour points of −13°C. to −15°C. it becomes essential that the wax crystals that form are sufficiently fine so that the wax crystals will pass through the screen and not block the screen and cut off the fuel supply of the engine.

The compositions of the invention will comprise a major amount of a middle distillate fuel oil and a minor amount of the amine-pour depressant-amorphous petrolatum usually in the range of about 0.005 to 0.500, preferably 0.01 to 0.2 wt. % of the total weight of the composition. In carrying out the invention the useful weight ratio of pour depressant to secondary amine generally is broadly from about 0.5 to 20 parts of pour depressant per part of amine and preferably from about 1 to 10 parts of pour depressant per part of amine. Further, the useful weight ratio of pour depressant to amorphous petrolatum is generally 0.2 to 10 parts pour depressant per par of amorphous petrolatum with said ratio preferably 0.5 to 2.0 parts of pour depressant per part of amorphous petrolatum. Usually, the total amount of the three types of additives, i.e. amine-pour depressant-amorphous was will be in the range of about 0.005 to 0.5 wt. %, preferably 0.01 to 0.2 wt. % (as previously stated) with the range of any component being in a cold flow combination improving amount of from about 0.001 to 0.2 wt. %.

For ease in handling, the mixture of the invention may be utilized in a concentrated form. For example, to faciliate storage and transportation, the aforedescribed mixture of the invention may be blended with a hydrocarbon solvent, e.g. a mineral oil, hexane, toluene, etc. to form a concentrate comprising from about 0.5 to about 60 weight percent, preferably ffrom about 10 to about 40 weight percent, of the inventive mixture and from about 40 to about 99.5 weight percent, preferably from about 60 to about 90 weight percent, hydrocarbon solvent.

EXAMPLE 1

0.03 wt. % of the aforedescribed secondary hydrogenated tallow amine having mixed $C_{16}$ and $C_{18}$ straight chain alkyl groups, was added to an atmospheric distillate heating oil, which was a mixture of 20 vol. % straight run stock and 80 vol. % of crack stock. This heating oil had a cloud point of −4°C., a pour point of −7°C., an aniline point of 57°C., an initial boiling point of 188°C., and a final boiling point of 340°C. The pour point (ASTM D-96-66) was reduced from the initial pour point of −7°C to −34°C.

EXAMPLE 2

In this Example, three different diesel fuels were used having the following characteristics.

Diesel fuel A had a cloud point of −14°C., a pour point of −21°C., aniline point of 64°C., IBP of 183°C., and FBP of 338°C., and was a mixture of about 60% heavy straight naphtha and 40% cracked stocks.

Diesel fuel B had a cloud point of −16°C., a pour point of −23°C., aniline point of 66°C., IBP of 184°C., and FBP of 337°C., and was a mixture of about 70% straight run and 30% cracked stocks.

Diesel fuel C had a cloud point of −18°C., a pour point of −23°C., aniline point of 61°C., IBP of 178°C., and FBP of 334°C., and was a mixture of about 50/50 straight run and cracked stocks.

These diesel fuels were treated with various amounts of the above-described secondary halogenated tallow amine. The fuels were also treated with a pour point depressant which was a concentrate of 55 wt. % light mineral oil vehicle and about 45 wt. % ethylene-vinyl acetate copolymer having a number average molecular weight of about 2,230 by Vapor Pressure Osmometry, having about 1.5 methylene terminated branches per thousand molecular weight as determined by NMR, and a relative molar ratio of about 4.7 moles of ethylene per mole of vinyl acetate in the copolymer. This copolymer was prepared by copolymerizing ethylene and vinyl acetate using dilauroyl peroxide at a temperature of about 105°C. under 1050 psig ethylene pressure. This is Pour Depressant A of Table II. In addition, a petrolatum was used with these diesel fuels which was an amorphous wax fraction (m.p. 44°C.) obtained by deasphalting a residual stock from a Texas coastal crude oil and then dewaxing the deasphalted residuum. This wax fraction was found to contain 5 wt. % of isoparaffins, 22 wt. % of aromatic hydrocarbons, 73% of cycloparaffins, and no more than a trace of normal paraffin hydrocarbons. The number average molecular weight of the amorphous wax was about 775 as determined by osmometry.

The resulting diesel fuel compositions were subjected to a low temperature filterability test which is conducted as follows: A 200 milliliters sample of the oil is cooled at a controlled rate of 4°F. per hour until a temperature of −18°F. (−28°C.) is reached. The oil is then filtered at −18°F. (−28°C.) through a 1 cm. diameter 270 mesh screen under 36 inches of water vacuum. The volume percentage of oil that has flowed through the screen in 60 seconds is then measured or if total flow is completed in less than 60 seconds the time to completion is noted.

The compositions of the various diesel oil blends tested and the test results obtained in the low temperature flow tests are given in Table I which follows. It will be seen from the data that combinations of the three additives just described are quite effective in improving the low temperature properties of each of the fuels over that when the fuel is treated with less than the inventive combination (compare: Test 3 with Tests 1 and 2; Test 6 with Tests 4 and 5; Test 10 with Test 7 and 9).

TABLE I

DIESEL FUEL FILTER TESTS

| Test | Fuel | Wt.%* Pour Depressant A | Wt.%* Di-alkyl Amine | Wt.%* amorphous Petrolatum | Wt. %* Total Additives | Test Results at −18°F.(−28°C.) ml through screen | time (sec.) |
|---|---|---|---|---|---|---|---|
| 1 | A | 0.135 | None | None | 0.135 | 0 | 60 |
| 2 | A | 0.045 | None | 0.084 | 0.129 | 130 | 60 |
| 3 | A | 0.030 | 0.030 | 0.033 | 0.093 | 200 | 30 |
| 4 | B | 0.135 | None | None | 0.135 | 0 | 60 |
| 5 | B | 0.032 | None | 0.075 | 0.107 | 30 | 60 |
| 6 | B | 0.025 | 0.027 | 0.027 | 0.079 | 200 | 30 |
| 7 | C | 0.135 | None | None | 0.135 | 0 | 60 |
| 8 | C | 0.018 | 0.020 | None | 0.038 | 200 | 30 |
| 9 | C | 0.032 | None | 0.075 | 0.107 | 160 | 60 |
| 10 | C | 0.015 | 0.017 | 0.018 | 0.050 | 200 | 30 |

wt.%* means the weight percent of active ingredient based on total weight of fuel.

EXAMPLE 3

Various other types of pour depressants were used in combination with the above-described secondary hydrogenated tallow amine and petrolatum to treat Fuel C. These types of pour depressants are described by the active ingredient in Table II although each type was added to Fuel C as a concentrate of active ingredient in a mineral oil vehicle. These blends were tested in a severe filter test which involved cooling the fuel blend from 10°F. (−12°C.) above to 10°F. below the cloud point, warming to the cloud point, and then cooling to −10°F. (−23°C.) all at 4°F. per hour, then filtering through a 1 cm. diameter 25 micron porosity screen at 6 inches of mercury vacuum. The composition of the blends tested and the test results are given in Table III.

Again it will be seen from the data that combinations of three additives are quite effective in improving the low temperature properties of the fuel.

TABLE II

DESCRIPTION OF POUR DEPRESSANTS

| Pour Depressant | Active Ingredient | Mol. Wt. (VPO) |
|---|---|---|
| A | 62% Ethylene/38% Vinyl Acetate Random Copolymer | 2,230 |
| B | Chlorinated Polyethylene, 11.5% Chlorine | 5,100 |
| C | 67% Ethylene/26.4% Vinyl Acetate/6.6% Di-iso-Tridecyl Fumarate Terpolymer. | 3,630 |
| D | 89% Ethylene/11% Propylene Copolymer | 1,495 |
| E | 62% Ethylene/38% Isobutyl Acrylate Copolymer. | 3,370 |
| F | 63% Butadiene/37% Styrene Copolymer, hydrogenated | 13,300 |
| G | Alkenyl Succinic Acid Mono-Amide (reaction product of molar amount of a di-hydrogenated tallow amine with a molar amount of alkenyl succinic anhydride wherein the alkenyl groups are isomerized $C_{15-20}$ mono-olefins.) | 773 |

TABLE III

DIESEL FUEL FILTER TESTS
(All Blends in Fuel C)

| Test | Pour Depressant Type | Pour Depressant Wt. %* | Wt.%* Di-alkyl Amine | Wt.%* Amorphous Petrolatum | Wt.%* Total Additives | Test Results at −23°C. ml. through screen | time (sec.) |
|---|---|---|---|---|---|---|---|
| 1 | A | 0.135 | None | None | 0.135 | 0 | 60 |
| 2 | A | 0.027 | None | 0.060 | 0.087 | 0 | 60 |

TABLE III-continued

DIESEL FUEL FILTER TESTS
(All Blends in Fuel C)

| Test | Pour Depressant Type | Pour Depressant Wt. %* | Wt.%* Di-alkyl Amine | Wt.%* Amorphous Petrolatum | Wt.%* Total Additives | Test Results at −23°C. ml. through screen | Test Results at −23°C. time (sec.) |
|---|---|---|---|---|---|---|---|
| 3 | A | 0.024 | 0.003 | 0.030 | 0.057 | 200 | 18 |
| 4 | B | 0.057 | None | 0.045 | 0.102 | 10 | 60 |
| 5 | B | 0.036 | 0.017 | 0.045 | 0.098 | 200 | 24 |
| 6 | C | 0.120 | None | 0.045 | 0.165 | 100 | 60 |
| 7 | C | 0.090 | 0.018 | 0.040 | 0.148 | 200 | 20 |
| 8 | D | 0.150 | None | 0.045 | 0.195 | 12 | 60 |
| 9 | D | 0.117 | 0.018 | 0.040 | 0.175 | 200 | 18 |
| 10 | E | 0.150 | None | 0.045 | 0.195 | 0 | 60 |
| 11 | E | 0.117 | 0.018 | 0.040 | 0.175 | 200 | 23 |
| 12 | F | 0.175 | None | 0.045 | 0.220 | 0 | 60 |
| 13 | F | 0.145 | 0.030 | 0.045 | 0.220 | 200 | 23 |
| 14 | G | 0.027 | None | 0.060 | 0.087 | 0 | 60 |
| 15 | G | 0.027 | 0.010 | 0.024 | 0.061 | 200 | 15 |
| 16 | | None | None | None | None | 0 | 60 |
| 18 | | None | None | 0.150 | 0.150 | 0 | 60 |
| 19 | | None | 0.020 | 0.090 | 0.110 | 0 | 60 |
| 20 | | None | 0.200 | 0.090 | 0.290 | 0 | 60 |

Wt.%* means the weight percent of active ingredient based on total weight of fuel.

After appraisal of Table II, one might conclude that the inventive combination improves the cold flow over any component or pair of components of this three-component additive combination of the invention. The combination of pour depressant and amorphous petrolatum is inferior to the inventive combination (compare Tests 8, 10, 12, 14, 16, 18 and 20 with Tests 2, 4, 6, 8, 10, 12 and 14. The combination of dialkyl secondary amine and amorphous petrolatum is inferior to the inventive combination (compares Tests 8, 10, 12, 14, 16, 18 and 20 with Tests 19 and 20).

In the data of Table IV it is seen that the combination of one pour depressant, namely, Pour Depressant A, and the secondary amine provided a unique improvement in cold flow improvement. Thus, it appears unique the combination of the secondary amine and a copolymer of ethylene and unsaturated mono- and diesters of the general formula:

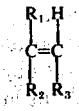

wherein $R_1$ is hydrogen or methyl; $R_2$ is a —$OOCR_4$ or —$COOR_4$ group wherein $R_4$ is hydrogen or a $C_1$ to $C_{16}$, preferably a $C_1$ to $C_8$ straight or branched chain alkyl group; and $R_3$ is hydrogen or —$COOR_4$. The copolymer of ethylene and vinyl acetate is preferred. In the unique combination the concentration of the secondary amine in the fuel is broadly from about 0.002 wt. % to 0.1 wt. %, preferably about 0.005 wt. % to 0.03 wt. % and the ethylene-ester copolymer concentration in the middle distillate fuel ranges broadly from about 0.003 wt. % to 0.02 wt. %, preferably about 0.005 wt. % to 0.1 wt. % with the total concentration of both in the fuel ranging from about 0.005 wt. % to 0.2 wt. %, preferably, 0.01 wt. % to 0.1 wt. % (all weight percent is based on total weight of the fuel composition).

Further indicative of the utility of the combination of the secondary amine and the ethylene-ester copolymer is date of Example 4.

EXAMPLE 4

Blends of the above-described pour depressant A and secondary hydrogenated tallow amine in the heating oil of Example 1 were made and tested for ASTM pour point with the results given in Table IV. The data show the synergistic effect on pour point upon combining these additives.

TABLE IV

COPOLYMER/AMINE COMBINATION POUR DEPRESSANTS

| Blend | Wt.%* Pour Depressant A | Wt.%* Amine | Wt.% Total Additive | Pour Point, °C. |
|---|---|---|---|---|
| 1 | 0.0090 | 0.0000 | 0.0090 | −37 |
| 2 | 0.0000 | 0.0100 | 0.0100 | −23 |
| 3 | 0.0060 | 0.0033 | 0.0093 | −40 |
| 4 | 0.0135 | 0.0000 | 0.0135 | −40 |
| 5 | 0.0000 | 0.0150 | 0.0150 | −29 |
| 6 | 0.0103 | 0.0037 | 0.0140 | −43 |
| Heating oil | 0 | 0 | 0 | −7 |

Wt.%* equals weight percent of active ingredient based on total weight of blend.

The invention in its broader aspect is not limited to the specific details shown and described and departures may be made from such details wihtout departing from the principles of the invention and without sacrificing its chief advantages.

What is claimed is:

1. A middle distillate fuel composition comprising a major amount of a middle distillate fuel oil improved in its cold flow properties by a flow-improving amount of the combination of: from about 0.0005 to 0.10 weight percent of a $C_8$ to $C_{30}$ dialkyl secondary amine with each alkyl group being straight chain; from about 0.003 to 0.20 weight percent of a pour point depressant; and, from about 0.025 to 0.50 weight percent of an amorphous petrolatum having a melting point in the range of about 25° to 60°C. and a number average molecular weight in the range of about 600 to 1,100 and substantially free of normal paraffins, whereby the cold flow properties of said fuel are improved, said weight percents being based on the total weight of said fuel composition, and wherein said pour point depressant is selected from the group consisting of:

A. oil-soluble ethylene copolymers having a number average molecular weight in the range of about 1,000 to 50,000, which are copolymers of 3 to 40 molar proportion of ethylene with a molar proportion of comonomer selected from the group consisting of (1) $C_3$ to $C_{16}$ alpha monoolefin, and (2) unsaturated ester of the general formula:

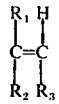

wherein $R_1$ is hydrogen or methyl; $R_2$ is a $—OOCR_4$ or $—COOR_4$ group wherein $R_4$ is hydrogen or a $C_1$ to $C_{16}$ alkyl group; and $R_3$ is hydrogen or $—COOR_4$;

B. chlorinated polyethylene of 1,000 to 20,000 number average molecular weight with a chlorine content of 4 to 35 wt. %;

C. a hydrocarbyl succinamic acid material of the formula:

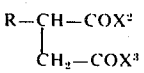

wherein R is a straight chain aliphatic hydrocarbon having from 0 to 1 site of olefinic unsaturation of from 14 to 40 carbon atoms and attached at a secondary carbon atom to the succinyl group; one of $X^2$ and $X^3$ is $—NYY^1$, wherein Y and $Y^1$ are aliphatic hydrocarbyl groups of from 14 to 40 carbon atoms, the other of $X^2$ and $X^3$ is of the formula:

$$—OH(NHY^2Y^3)n$$

wherein n varies from 0 to 1, $Y^2$ and $Y^3$ are hydrogen, aliphatic hydrocarbon of from 1 to 30 carbon atoms or oxyaliphatic hydrocarbon of from 1 to 30 carbon atoms, and may be taken together with the nitrogen to which they are attached to form a heterocyclic ring of from five to seven annular members; and D. hydrogenated copolymer of butadiene and styrene.

2. A middle distillate fuel composition according to claim 1, wherein said dialkyl secondary amine has alkyl groups of 14 to 24 carbon atoms each.

3. A middle distillate fuel composition according to claim 2, wherein said pour point depressant is a copolymer of ethylene and 3 to 20 moles of said unsaturated ester, said copolymer having a molecular weight in the range of about 1,000 to 5,000.

4. A middle distillate fuel composition according to claim 3, wherein said copolymer is a copolymer of ethylene and vinyl acetate.

5. A middle distillate fuel composition according to claim 3, wherein said unsaturated ester has the formula:

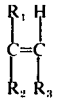

wherein $R_1$ is hydrogen or methyl, $R_2$ is $—COOR_4$ wherein $R_4$ is a $C_1$ to $C_8$ alkyl group, and $R_3$ is hydrogen.

6. A middle distillate fuel composition according to claim 2, wherein said pour point depressant is chlorinated polyethylene.

7. A middle distillate fuel composition according to claim 2, wherein said pour point depressant is said hydrocarbyl succinamic material, which is the reaction product of a molar amount of dihydrogenated tallow amine with a molar amount of alkenyl succinic anhydride wherein the alkenyl groups are isomerized $C_{15-20}$ monoolefins.

8. A middle distillate fuel composition according to claim 2, wherein said dialkyl secondary amine is secondary hydrogenated tallow amine.

9. A middle distillate fuel composition according to claim 8, wherein said pour point depressant is a copolymer of ethylene and vinyl acetate.

10. A middle distillate fuel composition according to claim 8, wherein said pour point depressant is chlorinated polyethylene.

11. A middle distillate fuel composition according to claim 8, wherein said pour point depressant is a copolymer of ethylene and isobutyl acrylate copolymer.

12. A middle distillate fuel composition according to claim 8, wherein said pour point depressant is said hydrocarbyl succinamic material, which the reaction product of a molar amount of dihydrogenated tallow amine with a molar amount of alkenyl succinic anhydride wherein the alkenyl groups are isomerized $C_{15-20}$ monoolefins.

13. An additive concentrate useful for treating distillate fuel to improve the cold flow properties of said oil comprising from about 60 to about 99.5 weight percent of a hydrocarbon solvent and from about 0.5 to about 40 weight percent of a mixture of one part of secondary hydrogenated tallow amine; 0.5 to 20 parts of a pour point depressant which is a copolymer of 3 to 20 molar proportions of ethylene with a molar proportion of vinyl acetate, said copolymer having a molecular weight of 1,000 to 5,000; and 0.2 to 10 parts of an amorphous petrolatum having a melting point in the range of about 25° to 60°C. and a number average molecular weight in the range of about 600 to 1,100 and substantially free of normal paraffins.

14. A fuel oil composition comprising a major portion of a middle distillate fuel and a flow improving amount of a cold flow-improving system containing 0.002 to 0.1 wt. % of a secondary amine having two straight chain alkyl groups of 8 to 30 carbon atoms each, and 0.003 to 0.02 wt. % of a pour point depressant having a number average molecular weight in the range of 1,000 to 50,000 comprising a copolymer of ethylene and an unsaturated mono- and diester of the general formula:

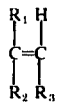

wherein $R_1$ is hydrogen or methyl; $R_2$ is a $—OOCR_4$ or $—COOR_4$ group wherein $R_4$ is hydrogen or a $C_1$ to $C_{16}$ straight or branched chain alkyl group; and $R_3$ is hydrogen or $—COOR_4$.

15. A fuel oil composition according to claim 14, wherein said secondary amine is secondary hydrogenated tallow amine.

16. A fuel oil composition according to claim 15, wherein said pour point depressant is ethylene-vinyl acetate copolymer having a molecular weight of 1,000 to 5,000.

* * * * *